United States Patent [19]

Swiatosz

[11] Patent Number: 4,568,820

[45] Date of Patent: Feb. 4, 1986

[54] SMOKE GENERATOR

[75] Inventor: Edmund Swiatosz, Maitland, Fla.

[73] Assignee: The United States of America as represented by the Secretary of the Navy, Washington, D.C.

[21] Appl. No.: 611,577

[22] Filed: May 18, 1984

[51] Int. Cl.[4] ..... H05B 3/40

[52] U.S. Cl. ..... 219/272; 219/326; 219/273; 219/276; 219/300; 239/136

[58] Field of Search ..... 219/271, 272, 273, 275, 219/276, 300, 325, 326; 252/302, 359 R, 359 CG; 239/135-138; 122/40, 41

[56] References Cited

U.S. PATENT DOCUMENTS

| | | | |
|---|---|---|---|
| 919,366 | 4/1909 | Lemp | 219/300 |
| 2,971,924 | 2/1961 | Peterson | 252/359 CG |
| 3,980,862 | 9/1976 | Hernborg | 219/273 |
| 3,982,351 | 9/1976 | Waldron | 252/359 CG |
| 3,990,987 | 11/1976 | Rogers | 219/300 |
| 4,326,119 | 4/1982 | Swiatosz | 239/136 |

FOREIGN PATENT DOCUMENTS

| | | | |
|---|---|---|---|
| 681554 | 3/1964 | Canada | 422/133 |
| 231536 | 3/1944 | Switzerland | 219/300 |
| 641739 | 8/1950 | United Kingdom | 239/135 |

*Primary Examiner*—Clifford C. Shaw
*Assistant Examiner*—Teresa J. Walberg
*Attorney, Agent, or Firm*—Robert F. Beers; Robert W. Adams

[57] ABSTRACT

A smoke generator and system for its employment is disclosed wherein a smoke is generated from a liquid smoke producing agent when the liquid is vaporized by pressurized 1000° F. air which has been heated in an electrical resistance coil. The systematic application requires modular use of the electrical resistance coils through an area to provide smoke from a variety of origins in accordance with the control exercised from a centrally located control panel. The smoke producing agent, the pressurized air, and the electrical current are supplied to each module via said control panel.

11 Claims, 3 Drawing Figures

SMOKE GENERATOR

BACKGROUND OF THE INVENTION

This invention relates generally to the field of training devices and in particular to training devices wherein simulated smoke is used for training realism. Even more particularly, the invention may be described as a smoke generator for use in training devices for such operations as simulating smoke from structural fires.

The use of simulated environments for training purposes has had an increase in recent years which may be proportionally linked to the increased cost of utilizing operational environments for training purposes. This is particularly true in the realm of fire fighter training, where the only operational equipment available for realistic training would be obsolete and unusable vehicles and structures. The use of such does not provide adequate control over the training environment as to allow the instructor to selectively stress aspects of the training; for example, re-ignition due to latent heat in an area after the fire is initially extinguished. To allow for controlled training exercises, reusable training devices or fire fighting simulators have been devised, such as: the Deep Fat Fryer Fire Fighter Simulator and Method of U.S. Pat. No. 4,299,579 to Swiatosz; the Fire Fighting Training Device and Method of U.S. Pat. No. 4,303,396 to Swiatosz; and the Navy's 19F1 series Fire Fighter Trainers. The current method for producing smoke for the 19F1 Fire Fighter Trainers utilizes a gas burner heat source for heating air to combine via nozzle injection with a smoke producing agent. The heat source supplies hot smoke to all locations in the trainer where smoke is to be simulated through heated pipes, which presents decomposition problems, hot pipe insulation problems, lack of adequate control at the egress point and the vaporization point, and a lack of remote control capabilities. Locating remote gas burners at the various locations would present additional plumbing problems, in effect requiring three fluid conduits to each location, and the burners would be subject to contamination by fire extinguishing agents directed thereupon by trainees.

In order to facilitate the production of smoke for training purposes, several smoke generators have been devised, including U.S. Pat. No. 4,326,119 to Swiatosz and U.S. Pat. No. 4,349,723 to Swiatosz, both of which heat the smoke producing agent and do not utilize heated air for vaporization. Likewise, U.S. Pat. Nos. 3,891,826 to Seuthe and 3,990,987 to Rogers, disclose smoke generators which directly heat the smoke producing agent via heat transfer from containment vessels heated by electrical current.

A venerable patent to Stephens, U.S. Pat. No. 2,066,703, discloses a pre-combustion atomization device to facilitate the burning of viscous hydrocarbon fuels, which is in some respects similar to the system currently in use and which correspondingly shares the disadvantages therewith, although it may be totally acceptable as a pre-combustion heater.

Each of the above devices are believed to be useful for their intended purpose; however, none are considered to provide an improved alternative to the currently employed system.

The instant invention, however, solves some of the problems faced by the previous art by virtue of its innovative approach, to wit: the smoke generator utilizes an electrically resistive heater tube in a coiled configuration to heat pressurized air as the air passes through the tubing. The temperature of the coil is controllable, as is the rate of flow of the air. The tubing is located at the point where the smoke is desired, and is connected to a vaporizing nozzle which also receives a liquid smoke producing agent. Both the smoke producing agent and the pressurized air are supplied by conduit from central sources, respectively, and are distributed at low temperature and controlled rates. The tubing, nozzle, temperature control apparatus, and connections to the conduits for air and smoke producing agents may be modular and may be replicated as disired at various locations in the trainer.

The present invention thus presents an advantage over the prior art that a volume of smoke may be simulated at various locations in a trainer without extensive use of heated ducting and its attendant insulation problems.

A further advantage of the present invention is the improved efficiency of the smoke producing agent utilization due to the absence of condensation in the ducting.

Yet another advantage is the ability to control the volume and density of the smoke at the individual modules from a central location.

These and other advantages, features and objects of the invention may be more readily understood by reference to the description of the preferred embodiment and to the accompanying drawings in which the same reference numeral designates the same component, throughout.

DESCRIPTION OF A PREFERRED EMBODIMENT

Figure 1:
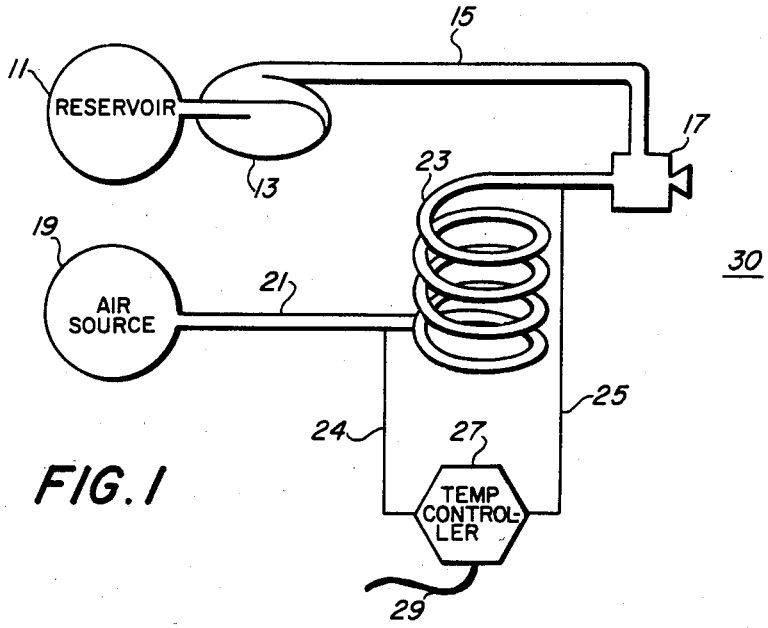
FIG. 1 is a block diagram of a smoke generator module and its components.

With reference to FIG. 1, wherein a basic depiction of the instant invention is shown, a reservoir 11 is provided to hold a supply of smoke producing agent in liquid form. One non-toxic substance found to be suitable for this purpose is triarylphosphate, commercially available from Tifa, Ltd., Millington, NJ, under the trade name Chem Chex 220. A pump 13 urges the smoke producing agent through a conduit 15 to a nozzle 17 at a predetermined pressure and flow. The smoke producing agent is not heated in any manner other than the heat generated by the compressive action of pump 13. A pressurized air source 19, which may be a dedicated compressor, compressed bottled air, or plant air from a shared source, is provided to supply pressurized air to a tubular coil 23 of electrically resistive material via conduit 21. The air is regulated and supplied in a range of from 60 to 100 psi. It has been found that a tubular coil having a tube diameter of ¼ inch and a 0.010 inch wall thickness with a tube length of 100 feet, made of stainless steel, performs adequately. Such a tube provides the appropriate electrical resistance to dissipate heat into the air from the $I^2R$ heating; serves as a conduit for the air with appropriate flow resistance for the amount of heated air for the desired smoke capacity;

and provides the proper amount of heat transfer to serve as a suitable heat exchanger.

Electrical current is supplied across tube 23 by leads 24 and 25 from temperature controller 27, which in turn receives electrical current from either a 110 or 230 V source, not shown, via power line 29. Temperature controller 27 is preferentially a unit such a Fluid Kinetics AD6 two-wire temperature controller which uses tube 23 as a sensing element to provide a constant surface temperature due to the variation of the tube resistance in relation to its temperature. The pressurized air passing through tubing 23 is thus heated to approximately 1000° and the air flow and current flow are adjustable to maintain this heat transfer relationship. Once the air is regulated at a specified quantity, the smoke producing agent is injected into the nozzle and vaporized. This vaporized smoke producing agent then exits nozzle 17 into the essentially open atmosphere denoted generally by 30 where the expansion and resultant condensation create a simulated "smoke". It may be noteworthy to mention that although pressurized gas at high temperature is forced into nozzle 17, the heat loss accompanying the expansion into the atmosphere at 30 is sufficient to significantly lower the temperature of the "smoke" to a level acceptable for firefighter training purposes.

Figure 2:
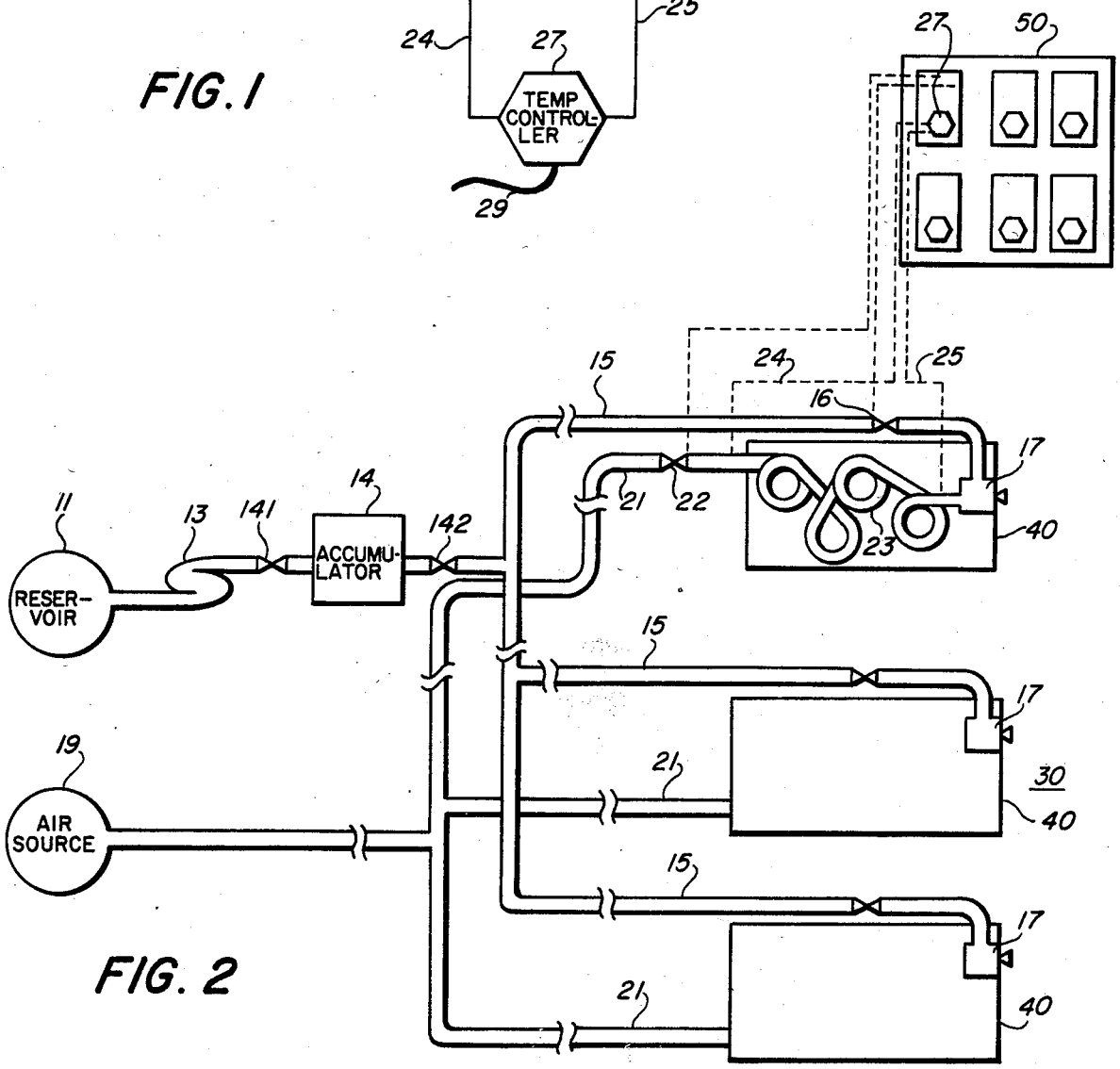
FIG. 2 is a block diagram of a network of smoke generator modules.

FIG. 2 illustrates in block diagram form how a distribution system of modular components may be effected. An accumulator 14 has been added to maintain pressure, through the action of valves 141 and 142, in conduits 15 so that the smoke producing agent is supplied at the appropriate pressure. A solenoid valve 16 controls the flow of smoke producing agent from conduit 15 to nozzle 17. Likewise, solenoid valve 22 controls the flow of pressurized air to nozzle 17. In the distribution network, solenoid valves 16 and 22 are controlled from a central control panel 50. Each nozzle 17 and tubular coil 23 can be packaged into or considered as a module 40, which may be placed as desired within a training facility. Each module 40 would have associated therewith a temperature controller 27 as described above which would be adjustable from said control panel 50, thus the flow of smoke producing agent, pressurized air, and electrical current would be controllable for a number of modules 40 at one point in a trainer. FIG. 2 also indicates that the pressurized air may be distributed from a central source 19, as may the smoke producing agent. In module 40, coil 23 is comprised of four 25' sections of tubing coiled in four inch coils and serially connected.

Figure 3:
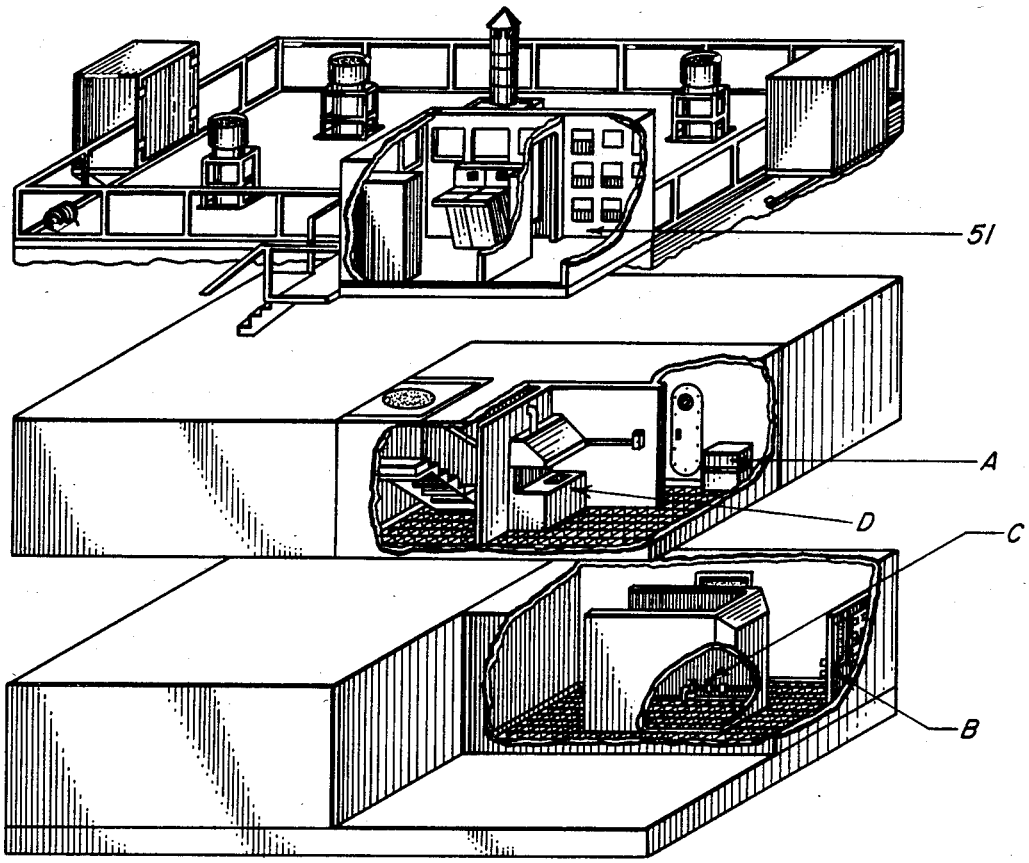
FIG. 3 is a pictorial rendition of a fire fighter trainer with the smoke generator module installed.

FIG. 3 illustrates the practical application of the instant invention in that it is a pictorial depiction of the 19F1 advanced fire fighter trainer showing four of the fourteen fire fighting simulators. The four simulators shown are a rag bale fire A, an electrical panel fire B, an oil spray bilge fire C, and a deep fat fryer simulator D. Deep fat fryer D is of the same type as shown in U.S. Pat. No. 4,299,579. Each location A, B, C, D, as well as the other ten fire simulators, require smoke to enhance their realism, and a module 40 may advantageously be placed at each location to provide smoke. In accordance with FIG. 2, then each module would be controllable from control 51 shown in FIG. 3. Such modules 40 may be located inside the simulators or proximate thereto to yield a realistic effect.

In operation, an instructor in control room 51 may select the appropriate module 40 for conducting a training exercise. The temperature controller 27 for the individual module may be calibrated to provide optimum tube surface temperature in coil 23 and the air pressure can be set for a desired smoke capacity such that controller 27 will automatically maintain an air temperature of 1000° F. Solenoid valve 16 is then set to match the air flow so as to balance the heat supply with the heat to be absorbed at injection nozzle 17.

Obviously many modifications and variations of the present invention are possible in light of the above teachings. It is, therefore, to be understood that within the scope of the appended claims the invention may be practiced other than as specifically described.

What is claimed is:

1. An apparatus for generating smoke from a vaporizable smoke agent material, comprising:

means for providing a supply of pressurized air;

means for providing a supply of said vaporizable smoke agent material;

means for providing a supply of electrical current:

a plurality of independent modules, each module having a heat generative, electrically resistive tube coupled to said current providing means and configured in four twenty-five foot sections of tubing coiled in four inch coils, with said four sections being connected in series and with said tube having an input coupled to said air providing means and an output, such that the air conveyed by said tube from its input to its output can be heated, and further each said module having a means coupled to said output of said tube and to said smoke agent material providing means for combining the smoke agent material with the heated air supplied at the output of said tube;

means coupled to said tube and to said current providing means, for controlling the rate of said electrical current supplied to said tube in accordance with the temperature thereof.

2. The apparatus of claim 1 wherein said tube is capable of heating air passing through said tubing to at least 1000 degrees F.

3. The apparatus of claim 1 wherin said current providing means is an alternating current power supply connected across said tube so as to form an electrical circuit therewith.

4. The apparatus of claim 1 wherein said electrical current controlling means comprises a temperature controller operably mounted proximal said tube to measure the heat radiated thereby, and to control said electrical current in accordance with a predetermined limit for heat transfer.

5. The apparatus of claim 1 wherin said tube comprises an electrically resistive tubing connected to complete an electrical circuit withsaid current providing means, and current controlling means is connected across said tube to measure the change in resistivity thereof as a function of temperature and control said rate of electrical current supplied accordingly.

6. The apparatus of claim 1 wherein said combining means is a nozzle to shear said smoke agent material into a vapor in conjunction with said pressurized air, having an inlet for said air connected to said tube and an inlet for said smoke agent connected to said smoke agent material providing means.

7. The apparatus of claim 1 wherein said means for providing a supply of said vaporizable smoke agent material comprises:

a reservoir for storing said smoke agent in liquid form;

pump means for urging said smoke agent toward said combining means;

conduit means connecting said reservoir, pump means, and combining means; and valve means in said conduit means between said pump means and said combining means.

8. The apparatus of claim 1 wherein said tube and combining means are disposed about an area such that a plurality of sources for smoke may be independently simulated.

9. The apparatus of claim 1 wherein each module has an independent means for controlling the rate of said electrical current supplied thereto.

10. The apparatus of claim 9 further comprising a control panel operably connected to each module such that the rate of electrical current supplied may be controlled at a location remote from said module, said control panel including means for variably setting the rate of electrical current supplied to each module individually.

11. The apparatus of claim 10, further comprising remotely controlled valve means associated with each module for controlling the rate of pressurized air and smoke producing agent received thereby.

* * * * *